United States Patent [19]

Hetzer

[11] Patent Number: 4,679,339

[45] Date of Patent: Jul. 14, 1987

[54] PRICE CASSETTE

[75] Inventor: Norbert Hetzer, Lobbach, Fed. Rep. of Germany

[73] Assignee: Esselte Pendaflex Corporation, Garden City, N.Y.

[21] Appl. No.: 732,262

[22] Filed: May 9, 1985

[30] Foreign Application Priority Data

Jun. 8, 1984 [DE] Fed. Rep. of Germany ..... 3421505

[51] Int. Cl.[4] ..... G09F 3/18

[52] U.S. Cl. ..... 40/10 R; 40/5; 40/446; 40/490

[58] Field of Search ..... 40/10 R, 446, 489, 490, 40/491, 5, 2 R, 308

[56] References Cited

U.S. PATENT DOCUMENTS

| | | | |
|---|---|---|---|
| 874,301 | 12/1907 | Cedarburg | 40/490 |
| 1,403,669 | 1/1922 | Chouinard | 40/490 |
| 3,539,204 | 11/1970 | Keller | 40/10 R |
| 4,171,584 | 10/1979 | Kaiser | 40/490 |

FOREIGN PATENT DOCUMENTS

| | | | |
|---|---|---|---|
| 2096377 | 10/1982 | United Kingdom | 40/446 |

*Primary Examiner*—Gene Mancene
*Assistant Examiner*—J. Hakomaki
*Attorney, Agent, or Firm*—Gerald J. Ferguson, Jr.; Michael P. Hoffman; Ronni S. Malamud

[57] ABSTRACT

A price cassette (1) is described which comprises a moulding (2) in which a plurality of parallel wells (14, 15, 16, 17, 18, 19) at least partially open towards the cassette front side and separated from each other by webs (9, 10, 11, 12, 13) are disposed for receiving price and/or information tags (31). The price cassette is provided with a cover (20) which is connected to the moulding and is adapted to be placed against the cassette front side for covering the wells. The cover comprises transparent window areas (22, 23) through which the price and/or information. tags can be read. The wells at the moulding are open over their entire length towards the cassette front side and the webs between the wells at least along a portion of their front faces (32) facing the cassette front side are formed in arrowhead shape.

5 Claims, 13 Drawing Figures

Figure 1:
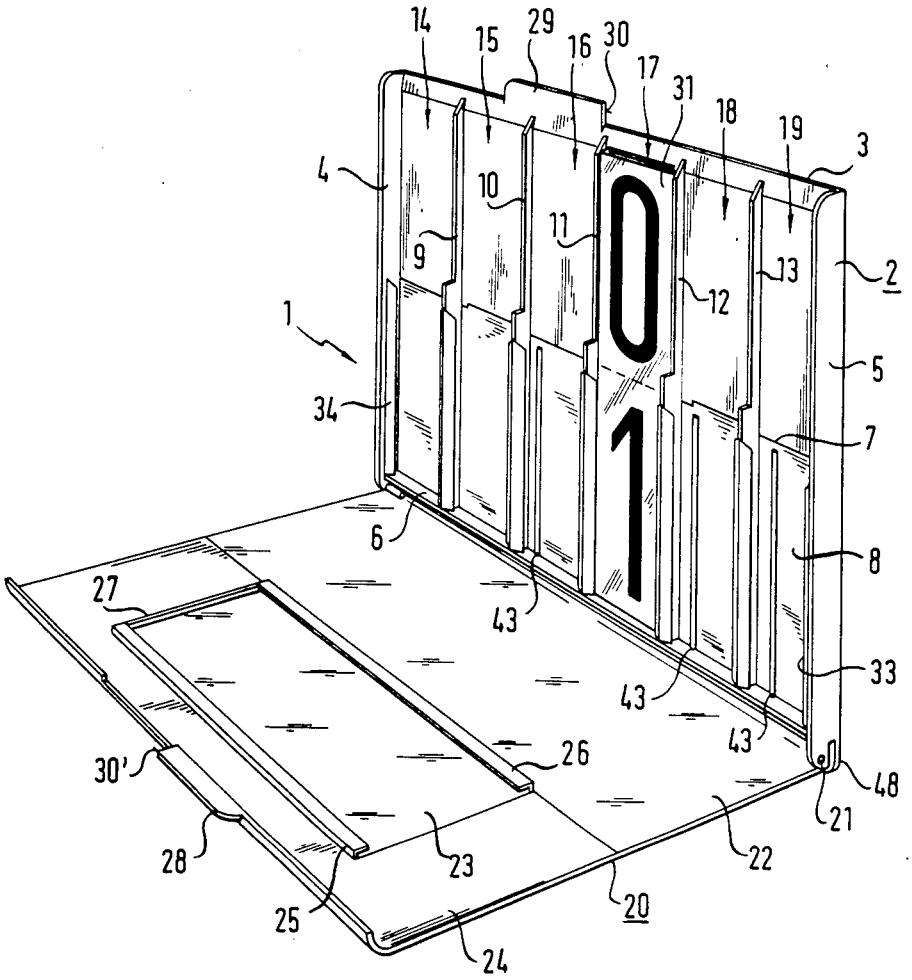

A
B
C
D

PRICE CASSETTE

The invention relates to a price cassette comprising a moulding in which a plurality of parallel wells at least partially open towards the cassette front side and separated from each other by webs are disposed for receiving price and/or information tags, and a cover which is connected to the moulding and adapted to be placed against the cassette front side for covering the wells, the cover having transparent window areas through which the price and/or information tags can be read.

Such price cassettes are particularly suitable for use in selling foodstuffs such as meat, sausage and cheese, which are usually offered for sale in counter-like glass vitrines. For hygenic reasons these glass vitrines must be frequently cleared and cleaned, and the price tags associated with the individual goods must be included in this cleaning operation. The price cassette of the type outlined is a structure which can be sealingly closed by a cover and has smooth outer surfaces which can easily be kept clean. In addition, by the cover the price and/or information tags contained in the cassette are protected so that they themselves need not be cleaned at all.

In such a price cassette to form the wells for receiving the price and/or information tags two mouldings are made and adhered together. The one moulding forms a closed rear wall on which at the two lateral edges thereof the side walls defining the depth of the cassette are integrally formed at right-angles. In the space between the two side walls and the rear wall the second moulding is inserted and has webs which extend at equal intervals apart parallel to the side walls and between said webs window openings whose height is equal to approximately half the total height of the cassette. In the upper half of this moulding the webs are connected together by a closed surface. The price and/or information tags are inserted in the known price cassette from the narrow upper side of the cassette into the individual wells. For each of the two mouldings for the production a separate injection mould is required and this considerably increases the production costs. Moreover, the insertion of the tags is a time-consuming operation carried out by hand which because of high labour costs also increases the cost of making the cassette.

The invention is based on the problem of further developing a price cassette of the type outlined in such a manner that it can be made with small expenditure of tools and work and thus at an extremely low cost.

According to the invention this problem is solved in that the wells at the moulding are open over their entire length towards the cassette front side and that the webs between the wells at least along a portion of their front faces facing the cassette front side are constructed in arrowhead shape.

Since in the price cassette according to the invention the wells at the moulding are open over their entire length towards the front side the price and/or information tags can be inserted from the front into the wells using automatic means. Consequently, manual operations are no longer necessary. Due to the arrowhead formation of the web front faces the tags are reliably held in the wells after they have been pressed into said wells along the inclined faces of the arrowhead shape. As a result, the tags cannot fall out during the further handling of the price cassette before closing the cover. In addition to the retaining function of the arrowhead form of the web front faces the angle is also increased at which the tags can be observed from a lateral viewpoint compared with an observation perpendicularly from the front without the particulars on the tags being concealed by the webs separating the wells.

Advantageous further developments of the invention are characterized in the subsidiary claims.

In one further development the moulding has a rear wall in which an opening is formed which is closed by a detachable insert plate and which is so large that all the web portions with arrowhead-shaped front faces lie within its boundary line. The provision of the opening in the rear wall leads to a considerable simplification of the mould in which the moulding is made. The undercut portions arising due to the arrow shape of the web front faces are no problem from the point of view of the injection moulding technique because to form the undercut portions a mould core projecting through the opening in the rear wall can be used. The mould separating movement necessary for removing the moulding and perpendicular to the plane of the rear wall is also favourable because the displacement paths to be covered by the parts of the injection mould can be kept short and thus take up very little time.

Figures 2, 3, 4, 5, 6:
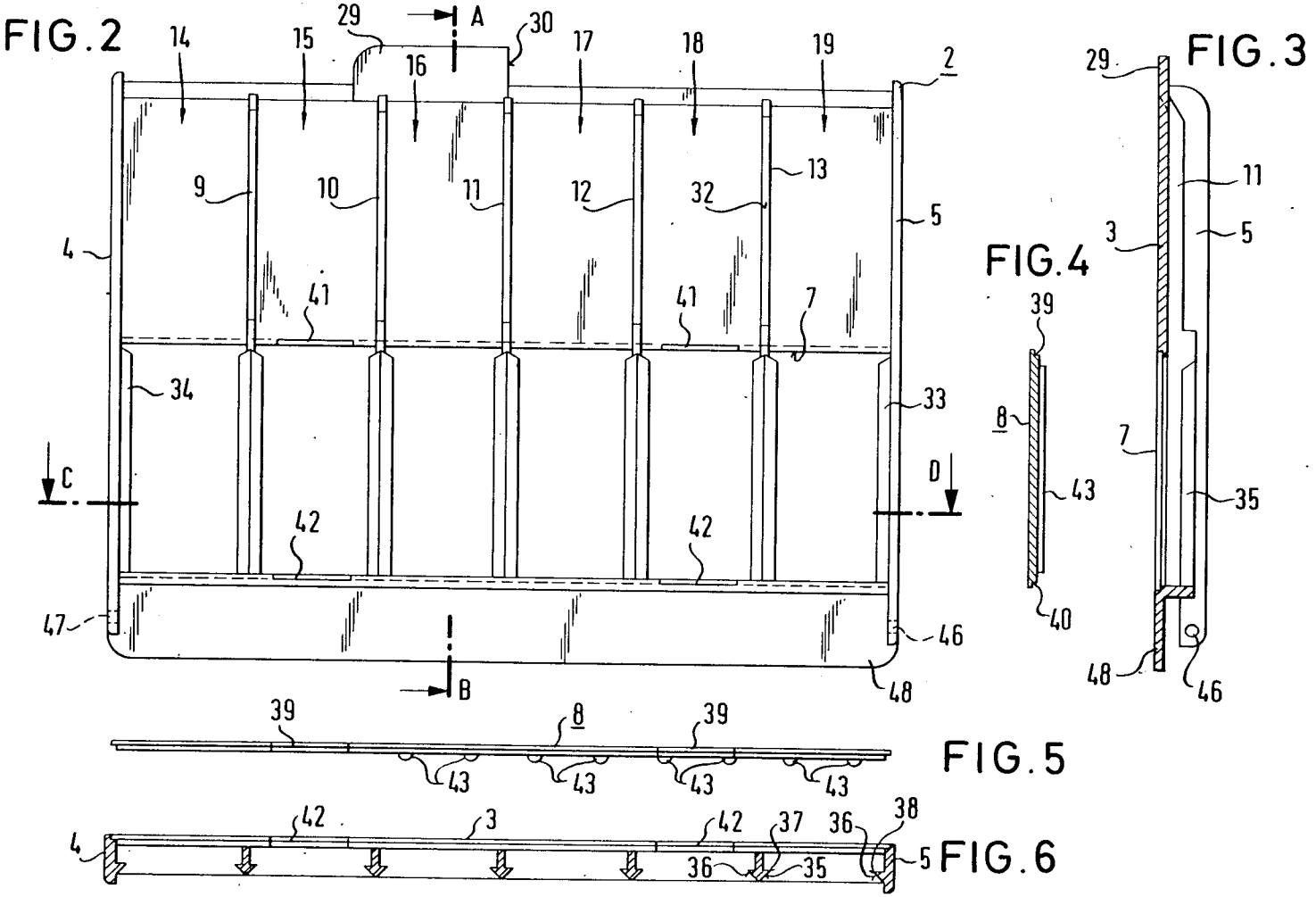
Figure 8:
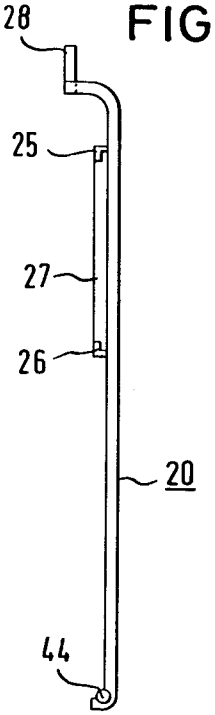
Figure 7:
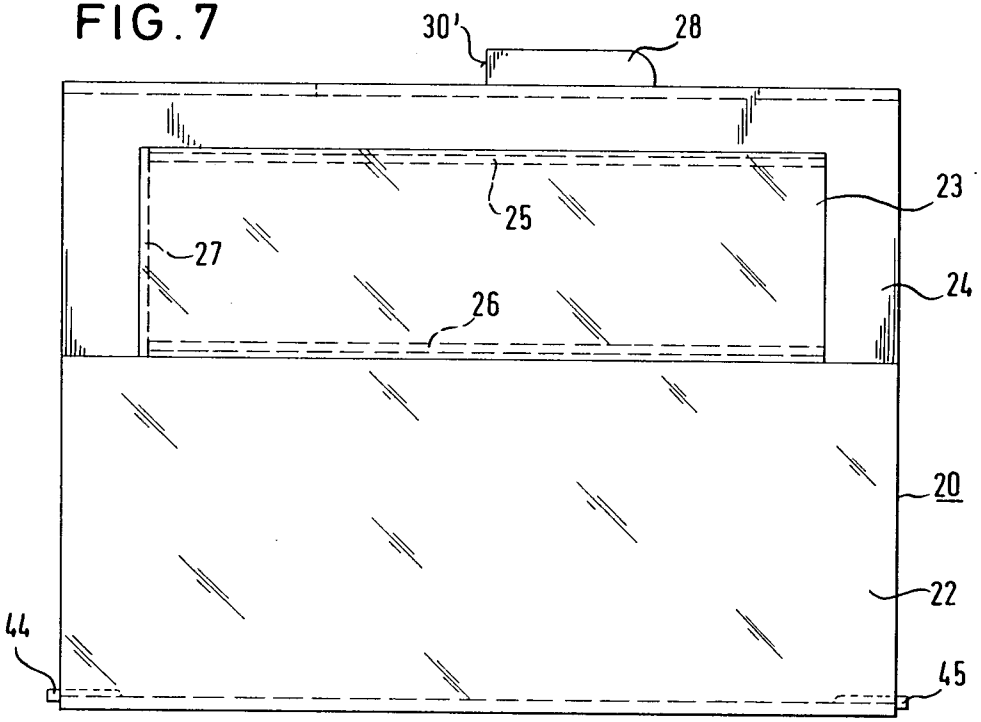
Figure 9:
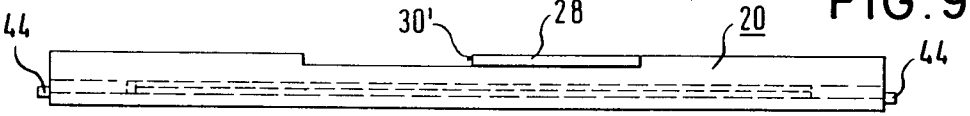
Figure 11:
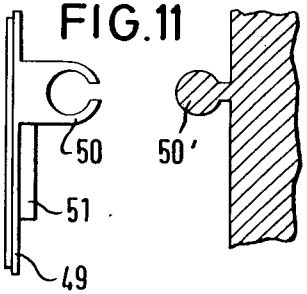
Figure 10:
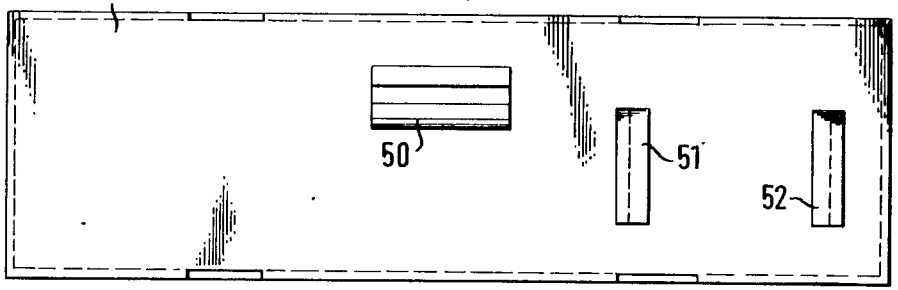
Figure 12:
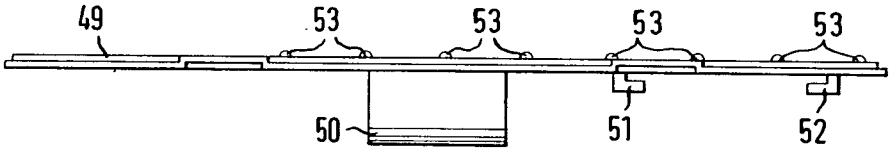
Figure 13:
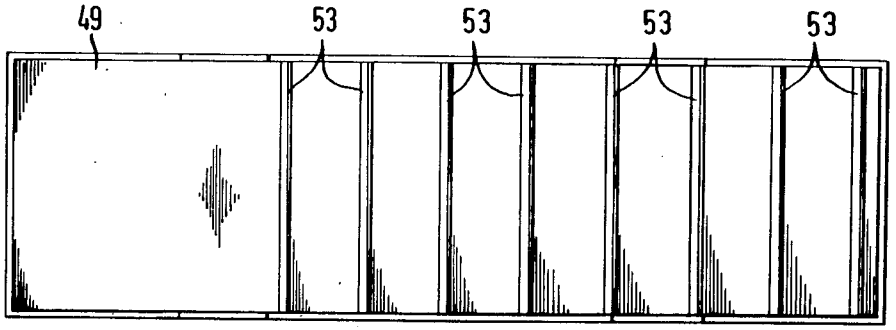

An example of embodiment of the invention will now be explained with the aid of the drawings, wherein:

FIG. 1 is a perspective view of a price cassette according to the invention with opened cover, FIG. 2 is a front elevation of the moulding of the price cassette of FIG. 1, FIG. 3 is a section along the line A-B of FIG. 2, FIG. 4 is a section of the insert plate for closing the opening provided in the rear wall of the moulding, FIG. 5 is a section along the line C-D of FIG. 2, FIG. 6 is a plan view of the insert plate represented in section in FIG. 4, FIG. 7 is a front view of the cover of the price cassette of FIG. 1, FIG. 8 is a side view of the cover of FIG. 7, FIG. 9 is a plant view of the cover of FIG. 7, FIG. 10 is a rear view of the insert plate, FIG. 11 is a side view of the insert plate with a support element for the price cassette, FIG. 12 is a plan view of the insert plate and FIG. 13 is a front view of the insert plate.

The price cassette illustrated in FIG. 1 comprises a moulding 2 which has a rear wall 3, two side walls 4, 5 formed on the rear wall 3 and defining the depth of the price cassette and a bottom wall 6. In the rear wall 3 an opening 7 is formed which is closed by means of an insert plate 8.

Formed on the rear wall 3 parallel to each other and to the side walls 4, 5 are webs 9 to 13 which define respective wells 14 to 19. The two outer wells 14 and 19 lie in each case between a web and one of the side walls 4, 5.

A further part of the price cassette is a cover 20 which is articulately connected to the moulding 2. In FIG. 1 one of the joint connections 21 between the cover 20 and the lower end of the side wall 5 can be seen. The cover 20 comprises two window areas 22 and 23 in which it is transparent. In contrast, in the region 24 surrounding the window area 23 to the top and laterally it is non-transparent. If the cover 20 is made in its entirety from transparent material the non-transparent area 24 can be obtained by applying paint or the like or by sticking on a non-transparent material.

Integrally formed on the inner side of the cover 20 are two guide rails 25 and 26 which extend parallel to the cover lower edge. At one end the two guide rails 25 and 26 are connected together by a stop web 27.

At the upper side of the cover 20 which is at the front in the opened position of FIG. 1 a tongue 28 is formed which cooperates with a tongue 29 on the upper side of the rear wall 3 to form a fastener. In the closed state the front edges 30 and 30' of the tongues 28 and 29 respectively extending parallel to the side walls engage with each other in such a manner that the two tongues 28, 29 can only be separated from each other after overcoming a certain frictional force for opening the cover 20.

The wells 14 to 19 serve to receive strip-like tags on which information is printed which when the cover is closed is visible through the window area 22. As example, in the well 17 a tag 31 formed by a digit strip is disposed which can consist of paper or plastic and on which the digits 0 to 9 are printed. By appropriately folding the strip the digits to be displayed can be brought to lie in the region of the well 17 visible through the window area 22. In FIG. 1 the digit 1 is shown. In the practical use the wells 16, 17, 18 and 19 serve to receive tags with digit information. In the well 14 tags may be placed with information on the country of origin of the goods marked and in the well 15 tags can be placed with information on the makeup and weight of the goods.

Between the guide rails 25 and 26 an information tag can be inserted on which the name of the goods marked is printed. Since the window area 23 of the cover 20 is transparent the goods name on the information tag can be read when the cover is closed. When the cover 20 is closed the information tag simultaneously covers the tag imprints disposed in the upper halves of the wells; the upper halves of the tags disposed in the wells 14 and 19 are also covered by the non-transparent area 24 of the cover 20.

In FIGS. 2 to 6 the moulding 2 and a first embodiment of the insert plate closing the opening 7 are shown in more detail. As apparent from FIGS. 2 and 5 the front face 32 of the web 13 separating the well 19 from the well 18 is formed in arrowhead shape in the half lying at the bottom in FIG. 2. The same also applies to all the other webs. Formed on the inner face of the side wall 5 is a projection 33 which corresponds to the half of the arrowhead form on the front face of the webs. A similar projection 34 is formed on the side wall 4. In this manner each well comprises in its lower half two introduction inclined faces 35 and 36 which make it possible to press price and information tags from the well front sides into the respective well. When this is done the tags arch in the direction towards the rear wall 3 and when they have been pushed past the side tips 37, 38 spring back behind the undercut portions formed by these tips and are thereby held reliably in the wells. A requirement for this is of course that the tags are wider than the distance between the tips 37 and 38 but not wider than the width of the wells.

An embodiment of the insert plate 8 is shown in FIGS. 4 and 6. This insert plate 8 closes the opening 7 in the rear wall 3 of the moulding 2. It is provided at its upper edge and at its lower edge with tongues 39 and 40 which engage in corresponding recesses 41 and 42 which are formed in the peripheral face of the opening 7 of the rear wall 3. The insert plate 8 is provided at its front side in the region of the wells 16, 17, 18 and 19 with protrusions 43 extending parallel to the webs. The purpose of these protrusions 43 is to reduce the depth of the wells in the direction of the rear wall 3 in the areas adjacent the webs so that the stack or strip of tags disposed in the wells is compressed and held in engagement at the undercut portions behind the tips 37 and 38. Since the protrusions 43 extend near the respective webs in the centre region of each well a greater well depth is available which permits the arching of the tags necessary for pressing the tags into the wells from the front side.

The provision of the opening 7 in the rear wall 3 of the moulding 2 permits particularly favourable production of the moulding 2 as injection moulding. Forming the undercut portions at the arrowhead-shaped web front faces does not involve any problems because a corresponding portion of the injection mould can project through the opening 7 from the rear up to the undercut portions behind the tips 37, 38. For separating the injection mould the portions thereof must only move through very short distances, the direction of movement being perpendicular to the plane of the rear wall 3. This shortens the production time required to make the moulding 2.

FIGS. 7, 8 and 9 show several views of the cover 20. In the front view of FIG. 7 the transparent window areas 22 and 23 and the non-transparent area 24 can be seen. As already mentioned, the cover 20 as a whole may be made from a transparent plastic material and the non-transparent area 24 can be obtained by applying a paint or the like or sticking on a non-transparent material. In the region of the lower edge of the cover 20 two pins 44, 45 are disposed which project beyond the side edges. These pins 44, 45 serve by engaging in corresponding holes 46, 47 in the moulding 2 (cf. FIGS. 2 and 3) to make the articulate connection to the moulding 2.

As clearly apparent from the sectional view of FIG. 3 the tongue 29 projects as an extension of the rear wall 3 upwardly at the price cassette 1. In the same manner this applies also to the tongue 28 on the cover 20 when the latter is closed. At the lower end of the rear wall there is a downwardly projecting extension 48 which extends over the entire width of the price cassette 1. Utilizing the tongues 28, 29 and the extension 48, the price cassette 1 can be inserted into a holder which comprises two opposing U-shaped grooves which are connected together at one leg by a wall. The free leg of the one groove engages round the tongues 28, 29 whilst the free leg of the other groove engages round the extension 48. The holder can have the form of a relatively long rail in the grooves of which several price cassettes 1 may be inserted adjacent to each other. An example of such a holder is illustrated and described in DE-GM No. 8,411,687.

In FIGS. 10 to 13 another embodiment of an insert plate 49 is illustrated which can be inserted instead of the insert plate 8 into the opening 7 in the rear wall 3 of the moulding 2. Formed at the rear side of said insert plate 49 are holding means with the aid of which the price cassette 1 can be secured to support elements. One of the holding means is clearly shown in the side view of FIG. 11. This is a C-shaped clamping means 50 which can be fitted on a rod-shaped support element 50'. Such a rod-shaped support element 50' could for example be disposed at the front side of a shelf bottom in a sales vitrine and the price cassette could be attached to said shelf bottom by fitting the clamping means 50 onto the rod-shaped support element 50'. As further holding means two guide rails 51, 52 are provided at the rear side of the insert plate 49 and with the aid of these rails the price cassette 1 can be secured to a strip-like support element which is inserted between the guide rails 51, 52. When the price cassette is secured by attaching the clamping means 50 an information tag can be inserted into the guide rails 51, 52 and projects from the cassette and carries an inscription such as "special offer" or the like. FIG. 13 shows the front view of the insert plate 49 of FIG. 10 on which protrusions 53 corresponding to the protrusions 43 are disposed.

I claim:

1. Price cassette comprising a moulding in which a plurality of parallel wells at least partially open towards the cassette front side and separated from each other by webs are disposed for receiving price and/or information tags, and a cover which is connected to the moulding and adapted to be placed against the cassette front side for covering the wells, the cover having transparent window areas through which the price and/or information tags can be read, characterized in that the wells (14, 15, 16, 17, 18, 19) at the moulding (2) are open over their entire length towards the cassette front side and that the webs (9, 10, 11, 12, 13) between the wells (14, 15, 16, 17, 18, 19) each include an arrowhead shaped edge along at least a portion of their front faces (32) facing the cassette front side so that (a) said price and/or information tags can be inserted from the cassette front side into the parallel wells, the insertion being facilitated by the inclined faces of the arrow shaped head whereby the tags buckle along their length as they are inserted and (b) the tags once inserted are held in place in the wells by the arrow shaped edges.

2. Price cassette according to claim 1, characterized in that the front faces (32) of the webs (9, 10, 11, 12, 13) comprise an arrowhead shaped portion along half their entire length and that the cover (20) is transparent in the entire area which lies in front of the well regions defined by webs (9, 10, 11, 12, 13) with arrowhead shaped front faces (32) when the cover (20) is closed.

3. Price cassette according to claim 1 or 2, characterized in that the moulding (2) comprises a rear wall (3) in which an opening (7) is formed which is closed by a detachable insert plate (8; 49) and which has dimensions such that all the web portions with arrowhead-shaped front faces (32) lie within its boundary lines.

4. Price cassette according to claim 3, characterized in that an outer surface of the insert plate (49) comprises holding means (50, 51, 52) for removably securing said insert plate (49) to support elements (50').

5. Price cassette according to claim 3 or 4, characterized in that an inner surface of the insert plage (8; 49), in the region of each well (14, 15, 16, 17, 18, 19), comprises at least two protrusions (43) extending parallel to the webs (9, 10, 11, 12, 13).

* * * * *